United States Patent [19]

Pav

[11] 4,389,932

[45] Jun. 28, 1983

BEST AVAILABLE COPY

[54] CALENDER WITH COMPOSITE OUTERMOST ROLLS

[75] Inventor: Josef Pav, Krefeld, Fed. Rep. of Germany

[73] Assignee: Kleinewefers GmbH, Krefeld, Fed. Rep. of Germany

[21] Appl. No.: 230,672

[22] Filed: Feb. 2, 1981

[30] Foreign Application Priority Data

Feb. 9, 1980 [DE] Fed. Rep. of Germany ..... 3004913

[51] Int. Cl.[3] ..... B30B 3/04

[52] U.S. Cl. ..... 100/162 B; 29/116 AD; 100/170

[58] Field of Search ..... 100/47, 162 R, 162 B, 100/163 R, 168–170; 29/113 AD, 116 R, 116 AD; 72/241, 245

[56] References Cited

U.S. PATENT DOCUMENTS

| | | | |
|---|---|---|---|
| 2,861,504 | 11/1958 | Kane | 100/170 X |
| 3,948,166 | 4/1976 | Wenzel | 100/163 R |
| 4,311,091 | 1/1982 | Pav et al. | 100/170 X |
| 4,319,522 | 3/1982 | Marchiorio | 100/162 B |

FOREIGN PATENT DOCUMENTS

| | | | |
|---|---|---|---|
| 1054953 | 4/1959 | Fed. Rep. of Germany | 100/163 A |
| 2254392 | 12/1976 | Fed. Rep. of Germany | 100/162 B |

*Primary Examiner*—Peter Feldman

*Attorney, Agent, or Firm*—Kontler, Grimes & Battersby

[57] ABSTRACT

A calender wherein the uppermost and lowermost rolls of the roll train have hollow cylindrical members with inserts which cooperate with corresponding shaft-like carriers to confine the cylindrical members to vertical movements relative to their carriers. The end portions of the carriers are mounted in bearings which are movable along vertical guides in the stand of the calender. The cylindrical members contain rows of hydraulic cylinder and piston units which urge the cylindrical members against the neighboring rolls of the roll train, and the inserts in one of the cylindrical members cooperate with the corresponding carrier to hold the respective cylindrical member against movement from a fixed end position which the cylindrical member assumes when the calender is in use. The bearings of the uppermost roll are movable downwardly by mechanical shifting devices to compensate for a reduction of diameters of the rolls which have undergone surface treatment, and the bearings of the lowermost roll have shoulders which are biased upwardly by hydraulic motors to bear against stationary stops on the stand. The cylinder and piston units in each of the cylindrical members can receive fluid at a different pressure to compensate for deformation of the respective cylindrical members and/or to change the pressure upon the material which is treated by the calender.

9 Claims, 3 Drawing Figures

CALENDER WITH COMPOSITE OUTERMOST ROLLS

BACKGROUND OF THE INVENTION

The present invention relates to calenders in general, and more particularly to improvements in calenders of the type wherein at least one of the rolls has a hollow cylindrical member which spacedly surrounds a shaft-like carrier and confines a displacing device serving to counteract the tendency of the cylindrical member to undergo deformation when the calender is in use.

German Auslegeschrift No. 22 54 392 discloses a calender wherein the lowermost roll of the roll train has a hollow cylindrical member surrounding a row of spaced-apart hydrostatic cylinder and piston units which compensate for deformation of the cylindrical member in response to stresses that develop when the calender is in use. More specifically, the just mentioned units serve to prevent undue deformation of the cylindrical member and to thus ensure that the peripheral surface of the cylindrical member is in proper linear contact with the peripheral surface of the adjacent roll. The carrier for the cylindrical member does not rotate and its end portions are mounted in bearings which are movable up and down relative to the stand. The end portions of the adjacent (next-to-the-lowermost) roll are also mounted in bearings which are movable up and down along suitable guide means on the stand. The pressure of fluid in the chambers of the aforementioned cylinder and piston units must suffice to compensate for the weight of the cylindrical member, for the weight of the remaining rolls of the roll train, for the stresses which develop as a result of reaction of the treated material while such material is conveyed through the calender, as well as to counteract the tendency of the cylindrical member to undergo deformation when the calender is in use. Each change in stressing of the cylindrical member entails a change in the flexing or bending forces and vice versa. This means that the regulating unit which controls the pressure in the cylinder chambers of the various cylinder and piston units must react to a host of variable parameters. The cylindrical member is most likely to be deformed in the region midway between its ends because the adjacent roll or counterroll is mounted in bearings which engage its end portions so that the median portion of such counterroll tends to bend and to apply a deforming stress to the cylindrical member of the lowermost roll.

OBJECTS AND SUMMARY OF THE INVENTION

An object of the invention is to provide a novel and improved calender which can be used for the treatment of a variety of flexible materials.

Another object of the invention is to provide a novel and improved roll train for use in a calender.

A further object of the invention is to provice novel and improved outermost rolls for use in the roll train of a calender.

An additional object of the invention is to provide a calender wherein the tendency of certain rolls to undergo deformation when the calender is in use can be counteracted in a simple and inexpensive manner.

Another object of the invention is to provide the calender with novel and improved means for ensuring that the pressure between the peripheral surfaces of neighboring rolls of the roll train can be selected, maintained and/or varied with a high degree of accuracy and reproducibility.

A further object of the invention is to provide a calender which can readily compensate for removal of material from the peripheries of certain rolls and which is constructed and assembled in such a way that a selected roll can be removed with minimal losses in time.

An ancillary object of the invention is to provide a novel and improved topmost or uppermost roll for use in the roll train of a supercalender or the like.

A further object of the invention is to provide a calender which can be readily converted for the treatment of any one of a wide variety of different materials and wherein at least one of the outermost rolls in the roll train can be held in a predetermined position for any desired interval of time.

Another object of the invention is to provide a calender which can automatically eliminate or prevent deformation of certain rolls with a high degree of accuracy and by resorting to a relatively simple and compact flexure preventing system.

The invention is embodied in a calender, i.e., a supercalender, which comprises a stand having upright guide means (e.g., two vertical rails which are provided on the front sides of the two sections or uprights of the stand) and a roll train which is mounted in the stand and includes a plurality of rolls comprising a first outermost roll which constitutes the lowermost roll of the roll train and a second outermost roll constituting the uppermost roll of the roll train. Each roll of the roll train is movable upon and down relative to the stand and each of the two outermost rolls comprises an elongated horizontal non-rotatable carrier which may constitute or resemble a rigid shaft, a rotary sleeve which surrounds the respective carrier and is movable with respect thereto radially of the corresponding outermost roll in parallelism with the guide means, hydrostatic displacing means installed in the respective sleeve and serving to urge the sleeve toward the nearest roll of the roll train, and bearing means for the respective carrier. Each bearing means is movable along the guide means and each of the sleeves is movable relative to the associated carrier to and from an end position. The sleeve and the carrier of one of the two outermost rolls have cooperating limiting means for holding the sleeve of the one outermost roll against movement beyond the respective end position under the action of the corresponding displacing means. The calender comprises means (e.g., a mechanical shifting device or a hydrostatic motor system) for moving at least one of the bearing means along the guide means.

Each of the bearing means comprises discrete first and second bearings for the respective end portions of the corresponding carrier, and the limiting means comprises first and second limiting devices which are respectively provided in the regions of the first and second end portions of the corresponding sleeve, i.e., of the sleeve forming part of the one outermost roll.

Each sleeve preferably comprises an elongated hollow cylindrical member and two inserts, one in each end portion of the cylindrical member. The aforementioned limiting means then comprises cooperating surfaces provided on the carrier of the one outermost roll and on the two inserts in the corresponding cylindrical member. The latter can rotate with respect to the inserts but the inserts cooperate with the corresponding carrier to hold the cylindrical member against reciprocatory movements in directions other than in parallelism with the guide means.

The novel features which are considered as characteristic of the invention are set forth in particular in the appended claims. The improved calender itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 3:
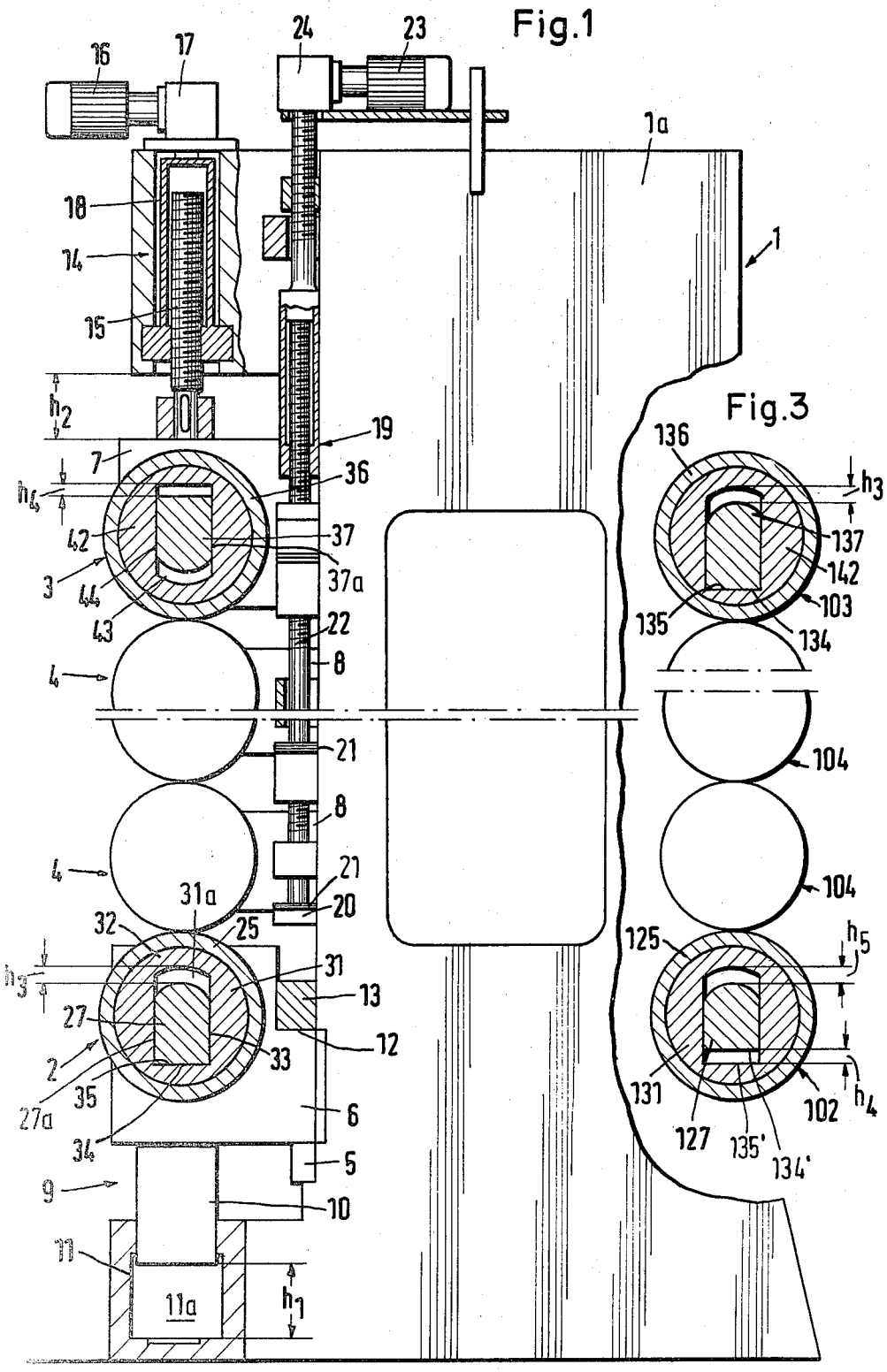
FIG. 1 is a fragmentary partly side elevational and partly vertical sectional view of a calender which embodies one form of the invention and wherein the lowermost roll of the roll train is movable to a fixed position, the section being taken in the direction of arrows as seen from the line A—A of FIG. 2.
FIG. 3 is a fragmentary partly side elevational and partly vertical sectional view of a modified calender wherein the uppermost roll of the roll train is movable to a fixed position with reference to the stand.
Figure 2:
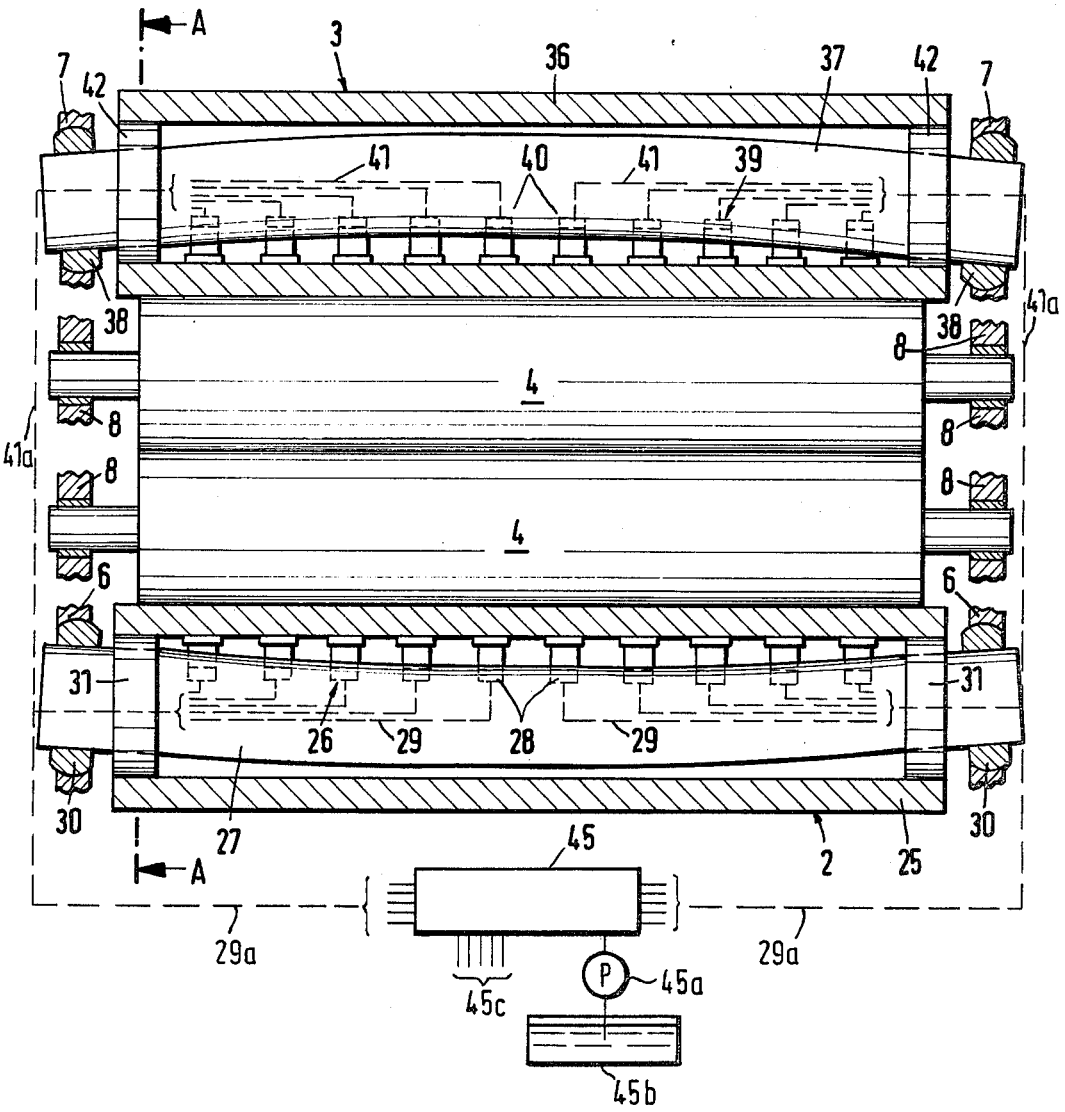
FIG. 2 is a fragmentary front elevational view of the calender of FIG. 1, with the two outermost rolls of the roll train shown in an axial sectional view.

Referring first to FIGS. 1 and 2, there is shown a calender which comprises a stand 1 having two uprights 1*a* (only one can be seen in FIG. 1) and a train of rolls between the uprights 1*a*. The rolls of the train in the illustrated calender include an outermost or uppermost roll 3, a lowermost or outermost roll 2 and several intermediate rolls 4. Each of the uprights 1*a* comprises or is connected with a vertical guide rail 5 for the bearings 6, 7 and 8 of the respective rolls 2, 3 and 4. The bearings 6–8 are movable up and down along the corresponding guide rails 5. The means for moving the bearings 6 for the lowermost roll 2 along the guide rails 5 comprises two hydrostatic motors 9 each having a stationary cylinder 11 and a vertical plunger 10 which is reciprocable in the chamber 11*a* of the cylinder 11 and is connected to the corresponding bearing 6. Each bearing 6 has a portion or shoulder 12 which abuts against a stationary stop 13 on the corresponding upright 1*a* when the bearings 6 are held in their upper end positions which are shown in FIGS. 1 and 2. The reference character $h_1$ denotes the distance through which the bearings 6 can descend from their upper end positions to the lower end positions in response to evacuation of pressurized fluid from the cylinder chambers 11*a*.

The bearings 7 for the uppermost roll 3 are suspended on two mechanical shifting or moving devices 14 each of which comprises a feed screw 15 connected with the corresponding bearing 7 and meshing with a sleeve-like nut 18 which is rotatable by a prime mover 16 (preferably a reversible electric motor) through the medium of a transmission 17. The reference character $h_2$ denotes the distance through which the shifting devices 14 can move the two bearings 7 for the uppermost roll 3 of the roll train.

The intermediate rolls 4 are mounted in such a way that they follow the upward or downward movements of the lowermost roll 2. In addition, the calender comprises a suspending unit 19 with abutments 20 for lugs 21 on the bearings 8 of the intermediate rolls 4. The lugs 21 come to rest on the respective abutments 20 when the lowermost roll 2 is moved by the motors 9 downwardly in order to increase the width of clearances or gaps between neighboring rolls.

The suspending unit 19 comprises discrete externally threaded sections 22 which allow for movements of the abutments 20 relative to each other. Thus, if a given section 22 is rotated relative to the other sections of the unit 19, the corresponding abutment 20 as well as all abutments therebelow move lengthwise of the corresponding guide rails 5. The composite feed screw of the suspending unit 19 can be rotated by a reversible electric motor 23 through the medium of a transmission 24. Thus, the motor 23 can be operated to lift or lower all of the abutments 20, and the individual sections 22 of the feed screw of the suspending unit 19 can be rotated relative to each other to change the mutual spacing of the abutments 20.

The lowermost roll 2 of the roll train comprises a hollow cylindrical member 25 which spacedly surrounds an elongated shaft-like carrier 27. The cylindrical member 25 accommodates a hydrostatic displacing means 26 which comprises a plurality of discrete hydraulically operated cylinder and piston units 28. The units 28 form a row which is parallel to the axis of the cylindrical member 25. The cylinder chambers of the units 28 can receive pressurized fluid from a source 45*a* (e.g., a pump which draws the fluid from a sump 45*b*) by way of channels 29 which are machined into the carrier 27 and communicate with conduits 29*a* leading to a regulating unit 45. The regulating unit 45 is designed to admit fluid at a given pressure to each individual cylinder and piston unit 28 or to groups of two or more cylinder and piston units. In FIG. 2, the displacing means 26 comprises a total of ten units 28 and the regulating units 45 can be designed to supply pressurized fluid to the left-hand group of five units 28 independently of the right-hand group of five units 28 or vice versa. FIG. 2 further shows that the end portions of the carrier 27 are mounted in the respective bearings 6 by way of tiltable annular members 30 so that the shaft-like carrier 27 (which does not rotate with the cylindrical member 25) can flex relative to the stand 1.

The two end portions of the cylindrical member 25 contain mounting means in the form of annular inserts 31 each of which has two parallel internal confining surfaces 33 abutting against complementary external confining surfaces 27*a* of the carrier 27. The surfaces 33 and 27*a* cooperate to hold the inserts 31 against rotation with the cylindrical member 25 and to confine the inserts 31 and the cylindrical member 25 to vertical movements relative to the carrier 27 (i.e., radially of the member 25 and in parallelism with the guide rails 5). Each insert 31 is further formed with an internal bottom surface 35 which cooperates with a complementary external surface 34 of the carrier 27 to limit the extent of upward movement of the inserts 31 and cylindrical member 25 with respect to the carrier 27. The cylindrical member 25 assumes its upper end position (shown in FIG. 1) with respect to the carrier 27 when the limiting surfaces 34 and 35 abut against each other, and the carrier 27 assumes its upper end position when the shoulders 12 of the bearings 6 abut against the respective stops 13 of the uprights 1*a*. The distance through which the cylindrical member 25 is movable relative to the carrier 27 is indicated at $h_3$. The cylindrical member 25 can rotate about the inserts 31.

The uppermost roll 3 also comprises a hollow cylindrical member 36 which spacedly surrounds an elongated shaft-like carrier 37. The end portions of the carrier 37 are tiltably but non-rotatably mounted in the respective bearings 7 by way of annular members 38 similar to the members 30 and shown in the upper portion of FIG. 2. The interior of the cylindrical member 36 accomodates a hydrostatic stressing or displacing means 39 which urges the member 36 toward the nearest intermediate roll 4, i.e., downwardly, as viewed in FIG. 1 or 2. The illustrated displacing means 39 comprises a row of hydraulically operated cylinder and piston units 40 which are or can be grouped in the same way as the units 28 in the cylindrical member 25 of the lowermost roll 2 and receive pressurized fluid from the regulating unit 45 by way of conduits 41*a* and channels 41, the latter being machined into the carrier 37. The regulating unit 45 can supply fluid at identical pressure to all of the units 40 or to smaller groups of such units, e.g., to the left-hand group of five units 40 and to the right-hand group of five units 40, as viewed in FIG. 2.

The end portions of the cylindrical member 36 surround annular inserts 42 which are analogous to the inserts 31 and have parallel internal confining surfaces 44 cooperating with complementary external confining surfaces 37*a* of the carrier 37 to hold the inserts 42 and the cylindrical member 36 to vertical reciprocatory movements relative to the carrier 37. The distance $h_4$ denotes the extent of movement of the cylindrical member 36 relative to the carrier 37. The reference character 43 denotes an elongated opening or cutout in that insert 42 which can be seen in FIG. 2; the other insert 42 has a similar cutout. It will be noted that the cutouts in the upper inserts 42 are mirror images of cutouts 31*a* in the lower inserts 31.

The manner in which the regulating unit 45 receives signals (via conductors 45*c*) to regulate the pressure in the cylinder and piston units 28 and 40 is not specifically shown in the drawing. Such signals are transmitted by suitable sensors which monitor the extent of deformation and/or displacement of the cylindrical member 25 relative to the carrier 27, the characteristics of the web of paper, textile or other material which is treated by the train of rolls 2–4, and/or certain parameters of the calender. The manner in which the position or configuration of the cylindrical member 25 can be monitored by sensors or detectors for generation of signals which are transmitted to a regulating unit is disclosed, for example, in commonly owned copending application Ser. No. 097,961 filed Nov. 28, 1979 by Pav et al. for "Roll for calenders or the like", now U.S. Pat. No. 4,290,353. The pressure of fluid in the cylinder chambers of the units 28 in the interior of the hollow cylindrical member 25 is sufficiently high to compensate for flexing of certain portions of the cylindrical member 25, to counteract the combined weight of the rolls 3 and 4, and to counteract the forces which are generated by the units 40 in the interior of the cylindrical member 36. Thus, the pressure in the cylinder chamber of the units 28 must at least equal that pressure which is needed to maintain the limiting surfaces 34 and 35 of the lower carrier 27 and the associated inserts 31 in contact with each other (see FIG. 1).

The pressure of fluid in the cylinder chambers of the units 40 is selected in such a way that the neighboring rolls of the roll train bear against each other with a preselected force which is best suited for proper treatment of a web of paper or the like running through the calender. The peripheral surfaces of the neighboring rolls are in linear or substantially linear contact with each other when the nips of such rolls do not receive a web of flexible material.

The pressure of fluid in the chambers 11*a* of the cylinders 11 is sufficiently high to ensure that, in normal operation, the portions or shoulders 12 of the bearings 6 invariably bear against the corresponding stops 13 on the uprights 1*a*. Thus, the pressure in the cylinder chambers 11*a* must suffice to prevent the bearings 6 from descending under the action of the cylinder and piston units 28 in the interior of the lower cylindrical member 25.

The aforediscussed pressures in the cylinder chambers of the various hydrostatic cylinder and piston units ensure that the lowermost roll 2 is invariably maintained in a predetermined position when the calender is in actual use. In such predetermined position, the internal surfaces 35 of the inserts 31 bear against the adjacent external surfaces 34 of the carrier 27 and the shoulders 12 bear against the respective stops 13. The bearings 7 for the uppermost roll 3 conform to such predetermined position of the lowermost roll 2 with the assistance from the shifting devices 14 in such a way that the stressing or displacing means 39 can apply a pressure without any resistance by stops or abutments against vertical movements of the cylindrical member 36. The distance $h_2$ should be selected in such a way that it can compensate for those changes in mutual positions of the rolls which are attributable to the changes in diameters of the rolls resulting from the treatment of external surfaces of the rolls. Such treatment is necessary from time to time to refinish the rolls.

As disclosed in the commonly owned copending application Ser. No. 232,197 filed Feb. 6, 1981 by Pav for "Calender", the sum of the distances $h_1$ and $h_3$ should suffice to allow for convenient removal of a selected roll from the stand 1 and for convenient reinsertion of such roll or for insertion of a fresh roll. The just mentioned commonly owned copending application further discloses means for ensuring that the evacuation of fluid from the cylinder and piston units 28 can begin simultaneously with evacuation of fluid from the cylinder chambers 11*a* so that the lowermost roll 2 is rapidly moved to its lower end position in which the attendants can reach and remove any one of the rolls 2, 3 and 4. Still further, the aforementioned copending application discloses means for regulating the downward movement of the cylindrical member 25 relative to its carrier 27 in such a way that the first stage of downward movement of the member 25 takes place practically without any interference on the part of means which allows the evacuation of fluid from the cylinder chambers of the units 28, and the second stage of such movement takes place at a gradually decreasing speed so that the cylindrical member 25 is braked and the roll 2 is much less likely to be damaged during movement to the lower end position in spite of the surprisingly short interval of time which the cylindrical member 25 requires to cover the distance $h_3$ with reference to the carrier 27. If the distance $h_3$ suffices to allow for removal of a roll from the stand 1 when the cylindrical member 25 reaches its lower end position with respect to the carrier 27, the regulating unit 45 is or can be designed with a view to allow for evacuation of fluid from the cylinder chambers of the units 28 independently of evacuation of fluid from the cylinder chambers 11*a*.

FIG. 3 illustrates a portion of a modified calender wherein all such parts which are identical with or clearly analogous to corresponding parts of the apparatus of FIGS. 1–2 are denoted by similar reference characters plus 100. The difference between the two embodiments is that the upper cylindrical member 136 which forms part of the uppermost roll 103 is invariably held in a predetermined position when the calender is in use. Thus, the external surfaces 134 of the carrier 137 then abut against the internal surfaces 135 of the two inserts 142 (only one can be seen in FIG. 3). The stressing or displacing means corresponding to the stressing means 39 of FIG. 2 is provided in the interior of the cylindrical member 125 which forms part of the lowermost roll 102. Thus, in the embodiment of FIG. 3, too, one of the outermost rolls (namely, the uppermost roll 103) is held in a predetermined position when the calender is in use. This, in turn, ensures that the position of the other outermost roll 102 is also fixed or determined with the requisite degree of accuracy. If the operator wishes to remove a roll, the motors (corresponding to the motor 9 of FIG. 1) are actuated to lower the bearings for the carrier 127 through the distance $h_1$ and the regulating unit (not shown in FIG. 3) is actuated to lower the cylindrical member 125 relative to the carrier 127 through the distance $h_5$. The reference character $h_4$ denotes in FIG. 3 the distance between the surfaces 135' and 134' of the insert 131 in the lower cylindrical member 125 and the carrier 127.

In certain instances, it may be desirable to provide the displacing means 26 and/or 39 with cylinder and piston units which act counter to the directions indicated in FIGS. 1 and 2. For example, and referring to FIG. 3, the cylinder and piston units which act upon the upper cylindrical member 136 can be mounted so as to tend to move the member 136 in directions counter to those in which the member 136 can be moved by the units 40 in order to compensate for or to prevent flexing of the member 136. Furthermore, each of the cylindrical members can accommodate more than a single row of cylinder and piston units. Reference may be has to the commonly owned copending application Ser. No. 196,123 filed Oct. 10, 1980 by Josef Pav et al. for "Roll for use in calenders or the like", now U.S. Pat. No. 4,328,744. This copending application discloses that a cylindrical member can accommodate two or more rows of cylinder and piston units which extend in parallelism with the axis of the respective roll. It is further possible to replace rows of discrete cylinder and piston units with elongated chambers which are filled with pressurized fluid and extend in the axial direction of the respective roll or rolls. The chambers are bounded by elongated strips.

An advantage of the improved calender is that it can be equipped with a greatly simplified regulating unit without affecting its operation. Thus, the forces which are needed when the calender is in use can be applied with a high degree of accuracy and reproducibility, and the friction between (and hence the wear upon) the neighboring moving parts is very low. Each roll can be moved to and maintained in an optimum position with reference to the stand and/or other rolls of the roll train. The force with which the neighboring rolls bear against each other (i.e., the pressure between the peripheral surfaces of neighboring rolls) can be regulated in response to signals from detectors (such as those disclosed in the commonly owned copending application Ser. No. 097,961 filed Nov. 28, 1979, now U.S. Pat. No. 4,290,353, by Pav et al. for "Roll for calenders or the like") which continuously monitor the parameters of the calender and of the web of material which is treated in the machine. The operation of the machine is practically free of vibrations, especially as regards the cylindrical members of the two outermost rolls, because at least one of these cylindrical members is invariably held in a fixed position so that it cannot move relative to the corresponding carrier except by rotating about its own axis. By way of example, the position of the cylindrical member 25 forming part of the lowermost roll 2 in the calender of FIGS. 1–2 if fixed by causing the surfaces 34 and 35 to bear against each other and also by causing the shoulders 12 to bear against the respective stops 13. This ensures that the member 25 cannot vibrate relative to the carrier 27 and that the carrier 27 cannot vibrate relative to the stand 1.

A further important advantage of the improved calender is that its lowermost roll can be readily moved to a position in which any one of the several rolls can be removed from the stand or reinstalled in the uprights.

A further advantage of the improved calender is that each and every roll of the roll train is movable up and down and that each of the two outermost (uppermost and lowermost) rolls has a cylindrical member which accommodates a battery of cylinder and piston units. Each such unit reacts against the corresponding carrier and bears against the adjacent portion of the cylindrical member, and the cylindrical member of one of the two outermost rolls is alway held in a predetermined position (this is the cylindrical member 25 in the embodiment of FIGS. 1–2 and the cylindrical member 136 in the embodiment of FIG. 3). Thus, the surfaces 35 or 135 of the inserts (31 and 142) which cooperate with such cylindrical members are held in actual contact with each other and the corresponding bearings abut against stationary stops to maintain the roll 2 or 103 in a predetermined position whenever and as long as the corresponding calender is in use. The feature that the bearings for the carrier of at least one of the two cylindrical members 25, 36 or 136, 125 are movable up and down by motor means (such as the motor 9 shown in FIG. 1) enables the attendants to rapidly prepare the machine for removal of any selected roll of the roll train or for installation of a repaired roll or a fresh roll.

An advantage of the feature that the uppermost roll 3 or 103 also comprises a cylindrical member (36 or 136) as well as at least one row of cylindrical and piston units therein (such as the units 40 shown in FIG. 2) is that the uppermost roll can receive forces at its ends for transmission to the stand by way of the corresponding bearings (such as the bearings 7), as well as intermediate its ends. Consequently, the median portions of the rolls can be subjected to substantial deforming stresses without actual deformation of the corresponding portions of the rolls. Moreover, and since only one of the two outermost rolls is invariably held in a predetermined position, the other outermost roll is mounted for floating movement relative to the stand and relative to the fixedly installed outermost roll. Consequently, when the one outermost roll (namely, the roll 2 or the roll 103) is moved toward its fixed position, all of the remaining rolls can follow to assume optimum positions for treatment of running webs of paper or the like. The means for moving the bearings of the outermost roll which is not held in a predetermined position when the calender is in use (such as the outermost roll 3 of FIGS. 1–2) renders it possible to compensate for removal of material from the peripheral surfaces of the rolls when the rolls must be subjected to material removing treatment. As explained in connection with FIGS. 1–2, such function is performed by the mechanical shifting means 14. The motors 9 and the corresponding motors (not shown) of the calender of FIG. 3 render it possible to rapidly separate the rolls to an extent which is needed to remove a selected roll from the stand.

The placing of surfaces 35 and 135 on the inserts which cooperate with the cylindrical members (25 and 136) of outermost rolls (2 and 103) which are movable to predetermined positions simplifies the design of the respective rolls and contributes to a reduction of the likelihood of vibration of such rolls. The inserts allow the respective cylindrical members to move up and down with reference to the corresponding carriers but hold the cylindrical members against any stray movements (i.e., against movements other than about the axes of such cylindrical members). Moreover, the provision of surfaces 35 and 135 on the inserts contributes to simplicity and compactness of the respective rolls.

The ultilization of a regulating unit (such as the unit 45) which can furnish fluid at different pressures to different cylinder and piston units (28 and 40 in the embodiment of FIGS. 1–2) brings about additional advantages. Thus, the operator can select the linear pressure between the neighboring rolls by changing the pressure in the chambers of selected units 40 without affecting the flexure-compensating action of the units 28 in the lower cylindrical member 25, or vice versa. Moreover, such regulating unit ensures that flexing of the two cylindrical members (such as 25 and 36) is negligible or non-existent irrespective of the pressure between the neighboring rolls.

The embodiment of FIGS. 1–2 is preferred at this time because the lowermost roll 2 is always held in a predetermined position when the calender is in use. The units 28 in the cylindrical member 25 compensate for eventual flexing of certain portions of the member 25, i.e., this is the sole function of the units 28. The load upon the uppermost roll 3 is selected in such a way that the units 40 in the interior of its cylindrical member 36 must provide a force (normally a relatively small force) which is needed for the treatment of a particular material, i.e., to furnish a force in addition to that which is generated by the weight of the rolls 3 and 4. As mentioned above, the pressure of fluid in the chambers of the units 28 in the interior of the lower cylindrical member 25 must suffice to withstand the weight of the rolls 3, 4 as well as the forces which develop as a result of admission of pressurized fluid into the chambers of the units 40 in the upper cylindrical member 36.

The sum of movements which are needed to maintain the neighboring rolls in proper engagement with each other after maximum removal of material from the peripheral surfaces of all rolls of the roll train must be less than or at most equals the distance $h_2$ shown in FIG. 1, i.e., less than the stroke of the uppermost bearings 7 relative to the guide means 5 on the corresponding uprights 1*a*. Thus, when a selected roll requires surface treatment which results in a reduction of its diameter, and the thus treated roll is reinstalled in the stand 1, the devices 14 are adjusted to compensate for the reduction of the diameter of the treated roll.

The devices 14 can be replaced by fluid operated devices or by even simpler mechanical devices; for example, the motors 16 can be replaced by wheels which are rotated by hand to move the feed screws 15 up or down. The motors 9 are preferably fluid-operated motors whose cylinder chambers 11*a* receive fluid at a pressure which invariably suffices to maintain the shoulders 12 in abutment with the respective stops 13 to thus ensure that the carrier 27 cannot vibrate relative to the stand 1. Such prevention of vibration of the carrier 27, coupled with prevention of vibration of the cylindrical member 25 relative to the carrier 27 (owing to the provision of inserts 31) greatly reduces the likelihood of vibration of the cylindrical member 25 when the calender is in use. Moreover, and as described in the commonly owned copending application Ser. No. 232,197 filed Feb. 6, 1981 by Josef Pav for "Calender", the use of fluid-operated motors 9 for the bearings of the carrier in the lowermost roll renders it possible to rapidly lower the lowermost roll to its lower end position so as to allow for removal of a selected roll, e.g., for the purpose of treating its peripheral surface. Thus, the evacuation of fluid from the cylinder chambers 11*a* can take place simultaneously with evacuation of fluid from the chambers of the units 28 so that the movement of the lowermost roll to its lower end position is completed within a surprisingly short interval of time. German published application No. 25 55 677 discloses a regulating device corresponding to the regulating device 45.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a calender, the combination of a stand having upright guide means; a roll train mounted in said stand and including a plurality of rolls which comprise a first outermost roll constituting the lowermost roll and a second outermost roll constituting the uppermost roll of said train, each roll of said train being movable up and down relative to said stand, each of said outermost rolls comprising an elongated horizontal nonrotatable carrier and wherein at least some of said rolls are subject to treatment for removal of material from their peripheries whereby the diameters of the thus treated rolls are reduced; a rotary sleeve surrounding each carrier and movable with respect thereto radially of the corresponding outermost roll; hydrostatic displacing means installed in each sleeve and arranged to urge the sleeve toward the nearest roll of said train; and bearing means for the respective carrier, said bearing means being movable along said guide means with each of said sleeves being movable relative to the corresponding carrier to and from an end position, the sleeve and the carrier of one of said outermost rolls having cooperating limiting means for holding the sleeve of said one outermost roll against movement beyond the respective end position under the action of the corresponding displacing means, wherein the extent of radial movement of the sleeve of said one outermost roll plus the extent of movement of the bearings of said one outermost roll relative to said guide means suffices to allow for removal of any selected roll of said train from said stand; and means for moving at least one of said bearing means including means for shifting said bearing means for the carrier of said uppermost roll lengthwise of said guide means so as to compensate for the reduction of diameters of the treated rolls, and hydrostatic motor moving means for moving the carrier of said lowermost roll upwardly relative to said guide means, said shifting means being arranged to perform strokes having a length which at least equals the anticipated maximum combined reduction of diameters of said rolls, said stand having stationary stop means and wherein the bearing means of said lowermost roll has at least one portion normally abutting against said stop means under the action of said motor.

2. The combination of claim 1, wherein each of said carriers and each of said sleeves has a first and a second end portion and each of said bearing means includes a first and a second bearing for the respective end portions of the corresponding carrier, said limiting means comprising first and second limiting devices respectively provided in the regions of the first and second end portions of the sleeve forming part of said one outermost roll.

3. The combination of claim 1, wherein each of said sleeves has a hollow cylindrical member spacedly surrounding the respective carrier and an annular insert provided in the cylindrical member and cooperating with the respective carrier to limit the cylindrical member to movements in parallelism with said guide means, said limiting means including a first portion provided on the carrier of said one outermost roll and a second portion provided on said insert.

4. The combination of claim 3, wherein said cylindrical members have first and second end portions and the sleeve of said one outermost roll has two inserts, one in each end portion of the respective cylindrical member.

5. The combination of claim 3, wherein said insert and the respective carrier include cooperating portions which hold the insert against rotation with the respective cylindrical member.

6. The combination of claim 1, wherein each of said displacing means includes a plurality of discrete cylinder and piston units forming a row extending in the axial direction of the respective sleeve and further comprising regulating means for supplying pressurized fluid to said units, the units of at least one of said displacing means forming a plurality of groups each of which can receive fluid at a pressure which is different from the fluid pressure in another group.

7. The combination of claim 1, wherein said one outermost roll is said lowermost roll.

8. The combination of claim 1, wherein at least some of said rolls are subject to treatment for removal of material from their peripheries whereby the diameters of the thus treated rolls are reduced, said moving means including means for shifting the bearing means for the carrier of said uppermost roll lengthwise of said guide means so as to compensate for such reduction of diameters of the treated rolls.

9. The combination of claim 1, wherein said means for moving includes a mechanical shifting device including a feed screw and motor means for moving said feed screw axially and in parallelism with said guide means.

* * * * *